US006820564B2

(12) United States Patent
Gnedenko et al.

(10) Patent No.: US 6,820,564 B2
(45) Date of Patent: Nov. 23, 2004

(54) SYSTEM AND METHOD FOR REMOVING BLOCKAGES IN A WASTE CONVERTING APPARATUS

(75) Inventors: Valeri G. Gnedenko, Moscow (RU); Alexandre L. Souris, Moscow (RU); David Pegaz, Netanya (IL)

(73) Assignee: E.E.R. Environmental Energy Resources Ltd., Ramat-Gan (IL)

( * ) Notice: Subject to any disclaimer, the term of this patent is extended or adjusted under 35 U.S.C. 154(b) by 0 days.

(21) Appl. No.: 10/398,398

(22) PCT Filed: Sep. 25, 2001

(86) PCT No.: PCT/IL01/00904

§ 371 (c)(1),
(2), (4) Date: Sep. 26, 2003

(87) PCT Pub. No.: WO02/29321

PCT Pub. Date: Apr. 11, 2002

(65) Prior Publication Data

US 2004/0074425 A1 Apr. 22, 2004

(51) Int. Cl.[7] ..... F23N 5/00; F23G 5/10

(52) U.S. Cl. ..... 110/187; 110/250; 110/235; 110/242; 110/238; 110/342; 110/101 CD; 110/101 CF

(58) Field of Search ..... 110/186, 187, 110/250, 235, 242, 238, 342, 101 CD, 101 C, 101 CF, 346

(56) References Cited

U.S. PATENT DOCUMENTS

| | | | | |
|---|---|---|---|---|
| 3,785,304 A | * | 1/1974 | Stookey | 110/346 |
| 4,831,944 A | * | 5/1989 | Durand et al. | 110/346 |
| 4,848,250 A | | 7/1989 | Wunderley | |
| 5,143,000 A | | 9/1992 | Camacho | |

FOREIGN PATENT DOCUMENTS

| | | |
|---|---|---|
| FR | 2708217 | 10/1995 |
| JP | 10 089645 | 4/1998 |
| JP | 10 110917 | 4/1998 |

OTHER PUBLICATIONS

Masatsugu, Yamagata "Vertical Melting Furnace" Abstract of JP2000018537, Patent Abstracts of Japan (Jan. 18, 2000).

Masatsugu, Yamagata "Vertical melting furnace for refuse incinerator—has external force application unit to add external force for preventing bridge formation in decomposed waste before fusion process" Abstract JP 10019221 A2, Patent Abstracts of Japan (Jan. 23, 1998).

Yasuo, Suzuki "Waste melting Furnace" Abstract of JP 05346218, Patent Abstracts of Japan (Dec. 27, 1993).

* cited by examiner

*Primary Examiner*—Kenneth Rinehart
(74) *Attorney, Agent, or Firm*—Browdy and Neimark, P.L.L.C.

(57) ABSTRACT

One or more auxiliary plasma torches are provided to a waste processing plant at strategic locations within the chamber and directed towards the waste column. When a bridge forms within the chamber the auxiliary plasma torches may be operated such as to provide an additional heat source where needed, quickly heating the organic solids, which thus pass through the bituminsation and charcoal formation stages quickly. The additional heat source may be in the neighborhood of the bridge, but may also be near the bottom end of the chamber, in which case the additional temperature at the bottom of the chamber effectively moves the combustion and gasification zones for the charcoal to a higher part of the chamber, altering the temperature profile. The heat source also enables the inorganic wastes to be heated rapidly to pass beyond the melting stage relatively quickly. The debridging process may be further enhanced by providing secondary plasma torches at various levels upwards of the primary torches, the secondary torches at any level being operated as and when needed to achieve the desired effect.

42 Claims, 9 Drawing Sheets

SYSTEM AND METHOD FOR REMOVING BLOCKAGES IN A WASTE CONVERTING APPARATUS

TECHNICAL FIELD

The present invention relates to an apparatus for the conversion of waste, including the processing, treatment or disposal of waste. In particular, the present invention is directed to a system and method for decongesting a furnace in a plasma torch based waste processing plant.

BACKGROUND

The processing of waste including municipal waste, medical waste, toxic and radioactive waste by means of plasma-torch based waste processing plants is well known. Referring to FIG. 1, a typical prior art plasma-based processing plant (1) comprises a processing chamber (10) typically in the form of a vertical shaft, in which typically solid, and also mixed (i.e., generally, solid plus liquid and/or semiliquid), waste (20) is introduced at the upper end thereof via a waste inlet means comprising an air lock arrangement (30). One or a plurality of plasma torches (40) at the lower end of the chamber (10) heats the column (35) of waste in the chamber (10), converting the waste into gases that are channeled off via outlet (50), and a liquid material (38) (typically molten metals and/or slag) which is periodically or continuously collected at the lower end of the chamber (10) via reservoir (60). Oxidising fluid, such as air, oxygen or steam (70) may be provided at the lower end of the chamber (10) to convert carbon, produced in the processing of organic waste, into useful gases such as CO and $H_2$, for example. A similar arrangement for dealing with solid waste is described in U.S. Pat. No. 5,143,000, the contents of which are incorporated herein by reference thereto.

Two problems commonly encountered that prevent smooth operation of such processing plants or furnaces are:—

(One) Bridging.

(Two) Unprocessed solid deposition.

The bridging phenomenon relates to a blockage that occurs as a result of the passage of solid material through a channel such as the chamber (10), the problem being further exacerbated when some of the solids liquefy. Many organic materials that may be found in the waste column (35) undergo a number of transformations during processing in the chamber (10). These transformations include, as a function of increasing temperature, the formation of gas products, the formation of liquid and semi-liquid pitch or bitumen, the evaporation of the pitch and charcoal or coke formation at high temperatures. These transformations may be occurring simultaneously at different parts of the furnace due to the temperature profile in the chamber (10). Thus, while raw or unprocessed waste may be found at the upper end of the waste column (35), the organic materials are converted to charcoal at the bottom end of the waste column (35), and to bitumen in a central portion of the waste column (35).

During the bitumnisation process of the organic waste, several pieces of bituminised waste may coalesce to form a full or partial bridge blockage in the furnace, as illustrated at (A) in FIG. 1.

Inorganic waste is normally dealt with at the lower, hotter parts of the chamber (10). Because of the non-homogenous composition of the waste and the temperature profile within the chamber (10), some inorganic waste may melt at higher portions of the chamber (10), and flow downwards, adhering to other waste and in some cases causing several pieces of waste to adhere to one another, resulting in a blockage. In fact, the molten waste may adhere to the walls of the chamber (10) and even crystalise there if the wall temperature is lower than the melting point of the waste, also leading to a bridge-type phenomenon within the chamber (10).

Another type of bridging phenomenon may occur as a direct result of the passage of solid waste through the furnace—a bridge-type formation, similar to a vaulted ceiling in form, can occur naturally within the refuse column, particular when the refuse is in granulated form, as illustrated at (B) in FIG. 1. The bridge-type formation provides a stable load bearing structure for the column of refuse, redirecting the weight of the column from the centre thereof to the edges in contact with the walls of the chamber (10), thereby preventing the flow of refuse via gravity through the furnace. The presence of a bridging phenomenon within the chamber (10) results in a reduction or total stoppage of the feed rate of waste through chamber (10).

Japanese Patent Application No. 10019221A2 addresses a bridging phenomenon problem by providing a number of mechanical devices which are inserted into the column of refuse from the sides or from the top of the furnace. These devices provide an external mechanical force to the waste in a direction towards the inside of the furnace, accomplished by either rotating members or axially displaceable members. While possibly effective in some cases, the mechanical devices are subject to a great deal of wear and tear and to high thermal stresses, and need to be replaced or serviced fairly frequently. Further, when not needed, the devices actually represent a partial blockage with respect to the column. The devices are also able to directly apply force in relatively isolated points within the furnace. Furthermore, incorporation of such mechanical devices in a furnace made from refractory material is not straightforward. Japanese Patent Publication Nos. JP 10 110917 and JP 10 089645 each describe a vertical melting furnace which is externally bulged to form a combustion space, thereby enabling continuous waste disposal. While these two patents are directed towards the prevention of bridging, they are not particularly effective in this regard, nor do not provide any solution to removing a bridging phenomena or for reducing propagation thereof French Patent No. 2,708,217 describes a plasma-torch based system in which the plasma arc is permanently submerged between the liquid products and the torch, within a reaction zone of the material being treated. Japanese Patent Application No. 05346218 describes a waste melting furnace in which a waste feed device, and air feed pipe and an auxiliary fuel feed device are provided to monitor and control melting conditions of the waste in order to minimise consumption of the auxiliary fuel. U.S. Pat. No. 4,831,944 describes another type of furnace wherein the plasma jets are inclined with respect to the corresponding radius of the column. U.S. Pat. No. 4,848,250 is directed to an apparatus and method for converting refuse to thermal energy, metal and slag devoid of particulate material. However, none of these references is directed to the problem of bridging, nor do they provide a solution therefore, less so in the manner of the present invention.

Waste material may comprise many different substances, some of which may have very high melting temperatures. Such substances may include, for example, refractory bricks, some types of rocks and stones, and also aluminium oxide ($Al_2O_3$). Furthermore, the waste may also contain products having a high aluminium content, and the aluminium may be oxidised to aluminium oxide by the hot oxidising means provided at the lower end of the chamber (10). The melting temperature for aluminium oxide is about 2050° C., and the melting point for other oxides that may also be found or formed within the waste column (35) include for example about 2825° C. for Magnesium oxide (MgO), and about 2630° C. for calcium oxide (CaO). However, the temperature at the lower end of the chamber (10), i.e., of the liquid material (38) is in the order of between about 1500° C. and about 1650° C. Thus, unprocessed solid deposition occurs when certain types of solid waste having a high melting temperature, or when some substances are transformed into oxides having a high melting temperature, rather than liquefy persist in a solid state during the normal operation of the furnace. The deposition of such solids at the lower end of the chamber (10) leads to blockage thereat, preventing run-off of liquid material (38) (typically molten metals and/or slag) to reservoir (60), as illustrated at (C) in FIG. 1. The same problem may occur when the viscosity of molten material is increased significantly due to a change in its composition. Thus, while this problem does not directly affect the feed rate of the waste through chamber (10), the flow rate of the liquid material (38) may be drastically reduced or stopped, which indirectly results in some reduction in the flow rate of refuse through the chamber (10). In the art, such "unprocessed solids" need to be treated with fluxing agent, which enable the solids to dissolve therein, forming solutions with relatively lower crystallisation temperature and of lower viscosity than the unprocessed solids may have in the liquid state. The resulting solutions are subsequently melted and removed from the lower part of chamber (10) in the normal manner. For example, Calcium Oxide (CaO), and Aluminium Oxide ($Al_2O_3$) each have relatively high individual melting points. However, if mixed together with quartz (Silicon Oxide ($SiO_2$)) in appropriate proportions (e.g., $SiO_{2-62}$%, CaO-23.25%, $A_2O_{3-14.75}$%), the resulting mixture begins to melt at about 1165° C., and liquid droplets begin to form at about 1450° C., which is well within the temperature range existing at the lower end of the chamber (10). Similarly, while the existence of quartz ($SiO_2$) or Aluminium Oxide ($Al_2O_3$) each increase viscosity and thus decrease the fluidity of liquid material (38), the addition of fluxing agents such as CaO, MgO, MnO, FeO serve to decrease viscosity of the liquid material (38) and thus to promote run-off thereof in some cases, Aluminium Oxide can act as a fluxing agent, the addition of small quantities thereof to slag containing large amounts of CaO having the effect of lowering the viscosity of the mixture. Unprocessed solids may be dissolved in liquid slag if in contact therewith, since the liquid slag comprises many different compounds in a dissociated state, enabling many different crystal compositions to be formed at different temperatures. The dissolving process is accelerated if the viscosity and surface tension of the melt are low, and these parameters will depend on the composition of the solids as well as of the melt, and on the temperature of the melt. It is also known that raising the temperature of the slag also serves to reduce its viscosity.

In the prior art, if and when it is determined that solid deposition has occurred, fluxing agents are then provided at the top end of the chamber (10) (typically manually) at the waste inlet means of the apparatus, which is somewhat ineffective since the agents have to percolate through the whole column of refuse, or at least pass together with the refuse to the lower part of the chamber, which takes a lot of time. If there is also bridging within the chamber (10), the fluxing agents cannot be applied to the solids, and thus the furnace has to be shut down, the refuse removed from the chamber and the bridging destroyed manually, before the solids can be accessed. Of course, by then all of the slag at the lower end of the chamber (10) has also solidified. In order to address either bridging or solid deposition within the processing chamber of a plant, the first step is to identify the presence thereof This not a simple matter, and is in fact significantly complicated in many instances by other factors.

For example, one indicator of the presence of bridging and/or of solid deposition is a decrease in the flow rate of waste through the processing chamber. However, as explained in more detail below, the changing composition of the waste itself may also affect the waste flow rate.

The composition of waste provided to the processing chamber may vary tremendously over any given time period, and may include any relative proportions of organic to inorganic waste, and any relative proportion of liquids to solids. While organic waste is converted to product gases (using oxygen-containing reagents), inorganic waste needs to be melted to a liquid, whose viscosity will depend on the constitution of the inorganic waste and the temperature thereof. Thus, if the waste that is fed to the processing chamber comprises a high proportion of inorganic material, there may be a decrease in the flow rate of waste through the chamber and/or solid deposition, simply because the primary plasma torches cannot deal with the large quantity of inorganic waste quickly enough. It is not generally possible to measure the concentration of some of the inorganic components of the waste—such as stones and glass, for example—and usually visual monitoring of the waste by the plant operators is the only way of providing any estimate regarding the composition of any batch of waste being fed to the plant. When it is determined that the waste comprises a high degree of inorganic waste, then either the waste needs to be diluted with organic waste, or the feed rate to the processing chamber needs to be reduced.

On the other hand, a different problem is encountered when the waste comprises high levels of organic waste. Here, carbon in the form of coke or charcoal is produced at higher than normal amounts after drying and pyrolysis of the waste. Correspondingly, greater amounts of oxidising agents must be provided to convert the carbon to product gases. If the oxidising agents include steam, then more power is needed to be provided to the chamber since steam reacts with carbon endothermically. Unless more oxidising agents are provided together with greater power by the primary plasma torches, the flow rate of waste through the processing chamber will decrease, and it will then difficult to determine if the lowering in the waste flow rate is as a result of bridging or of coke build-up.

Thus, the waste flow rate through the processing chamber is not only affected by the presence of bridging and/or solid deposition, but also by the actual composition of the waste.

Another indication that there is solid deposition may be provided by an increase in the level of liquid product within the chamber. However, high viscosity of inorganic liquids at the lower end of the chamber also results in a slower rate of flow of liquid product, which in turn leads to a rise in the level thereof. It is not normally possible to determine whether the cause of a rising level of liquid product is solid deposition, or the high viscosity of the liquid product, or a mixture of the two. In any case, as in the case of solid deposition, fluxing agents as well as additional power to the chamber may help to lower the viscosity of the liquid product and thus provide a solution when this problem is encountered.

It is therefore an aim of the present invention to provide a system for dealing with bridging phenomena which overcomes the limitations of prior art systems and methods.

It is another aim of the present invention to provide such a system incorporated as an integral part of a plasma-torch based type mixed waste converter.

It is another aim of the present invention to provide a second system for dealing with unprocessed solids directly in a plasma-torch type processing apparatus.

It is another aim of the present invention to provide such a second system that incorporates a fluxing agent feed system for feeding fluxing agent directly into a plasma-torch type processing apparatus.

It is another aim of the present invention to provide such system that are relatively simple mechanically and thus economic to produce as well as to maintain.

It is another aim of the present invention to provide a method for operating a plasma-based waste processing plant such as to minimise blockages therein due to bridging and/or unprocessed solids.

The present invention achieves these and other aims by providing at least one and preferably a plurality of auxiliary plasma torches at strategic locations within the chamber (10) and directed towards the waste column. When a bridge forms within the chamber (10) one or more auxiliary plasma torches may be operated such as to provide an additional heat source where needed. This heat source serves to quickly heat the organic solids and thus pass through the bituminsation stage and to the charcoal formation as quickly as possible. The additional heat source may be in the neighborhood of the bridge, but may also be near the bottom end of the chamber (10). In the latter case, the additional temperature at the bottom of the chamber (10) effectively moves the combustion and gasification zones for the charcoal to a higher part of the chamber, altering the temperature profile. This helps to pass the bituminisation stage quickly, and effectively destroys such bridges. The heat source also enables the inorganic wastes to be heated rapidly to pass beyond the melting stage relatively quickly. The debridging process may be further enhanced by providing secondary plasma torches at various levels upwards of the primary torches, the secondary torches at any level being operated as and when needed to achieve the desired effect. Further, the heat source also enables a thermal shock front to be directed at the bridge, disrupting and/or destroying and/or melting the bridge, which is also useful for dealing with bridge-type phenomena which occur naturally due to the flow of solids along the chamber (10). The chamber may also be provided with at least one fluxing agent inlet at the lower part of the chamber such as to enable appropriate fluxing agents to be directly applied to the deposited "unprocessed solids" and/or to liquid products of high viscosity.

SUMMARY OF INVENTION

The present invention is directed to a system for maintaining substantially decongested a waste converting apparatus, the waste converting apparatus having a waste converting chamber adapted for accommodating a column of waste, at least one primary plasma torch means for generating a hot gas jet at an output end thereof and for directing said jet towards a bottom longitudinal part of the chamber, said system comprising:— at least one waste flow rate sensing means at least for detecting a first predetermined status of a flow rate of waste in said chamber;

at least one liquid product level sensing means at least for detecting a second predetermined status of a liquid product level in said chamber;

at least one secondary plasma torch means having an outlet in said chamber such that during operation of said system a high temperature zone may be selectively provided within said converting chamber for at least partially removing a bridge-type congestion from said chamber and/or to substantially prevent occurrence or propagation of such a congestion;

said secondary plasma torch means being selectively operable at least in response to said predetermined first status and said predetermined second status being detected.

The secondary plasma torch means may be located intermediate between said primary plasma torch means and an upper portion of said chamber. The said waste converting apparatus may comprise at least one gas outlet means at an upper longitudinal part of the chamber, and at least one said secondary plasma torch means may be located within a lower third of the said chamber taken vertically between said primary plasma torch means and said gas outlet means. Additionally or alternatively, at least one said secondary plasma torch means is located within a middle third of the said chamber taken vertically between said primary plasma torch means and said gas outlet means.

The first predetermined status may correspond to a detected waste flow rate lower than a predetermined minimum; the said second predetermined status corresponds to a detected liquid product level not greater than a predetermined maximum.

The present invention also relates to an apparatus for converting waste comprising:— a waste converting chamber adapted for accommodating a column of waste, said chamber having an upper end;

at least one primary plasma torch means for generating a hot gas jet at an output end thereof and for directing said jet towards a bottom longitudinal part of the chamber;

at least one liquid product outlet means at a lower longitudinal part of said chamber;

said apparatus further comprising a first decongestion system for decongesting waste within said waste converting apparatus, said first system comprising:— at least one waste flow rate sensing means at least for detecting a first predetermined status of a flow rate of waste in said chamber;

at least one liquid product level sensing means at least for detecting a second predetermined status, of a liquid product level in said chamber;

at least one secondary plasma torch means having an outlet in said chamber such that during operation of said system a high temperature zone may be selectively provided within said converting chamber for at least partially removing a bridge-type congestion from said chamber and/or to substantially prevent occurrence or propagation of such a congestion;

said secondary plasma torch means being selectively operable at least in response to said predetermined first status and said predetermined second status being detected.

Preferably, the at least one secondary plasma torch means is located intermediate between said primary plasma torch means and said upper end of said chamber.

The apparatus typically at least one gas outlet means at an upper longitudinal part of the chamber, and at least one said secondary plasma torch means is located within a lower third of the said chamber taken vertically between said primary plasma torch means and said gas outlet means. Optionally, at least one said secondary plasma torch means is located within a middle third of the said chamber taken vertically between said primary plasma torch means and said gas outlet means.

The first predetermined status typically corresponds to a detected waste flow rate lower than a predetermined minimum, while the second predetermined status typically corresponds to a detected liquid product level not greater than a predetermined maximum.

Preferably, the apparatus comprises a plurality of said second plasma torch means. At least some of said plurality of said second plasma torch means may distributed longitudinally and/or circumferentially with respect to said chamber.

The apparatus may further comprise at least one, and preferably a plurality of application points adapted for selectively enabling introduction of a plasma torch means with respect to said chamber. Each said application point typically comprises a suitable sleeve for accommodating therein a said second plasma torch such that during operation of said second plasma torch a high temperature zone provided inside the chamber at a predetermined location correlated to said corresponding application point, and wherein said sleeve is selectively sealable to prevent communication between the chamber and the outside when said sleeve is not accommodating a said second plasma torch. At least some of said plurality of said application points may be distributed longitudinally and/or circumferentially with respect to said chamber.

The apparatus preferably further comprises suitable control means for controlling operation of said first decongestion system operative connected to the waste flow rate sensing means, the liquid product level sensing means and the secondary plasma torch means. The apparatus preferably also comprises at least one suitable gas flow rate sensing means for monitoring the volume flow rate of product gases provided by said apparatus via said gas outlet means, and control means is operatively connected to said gas flow rate sensing means.

The apparatus typically further comprises waste inlet means associated with said upper part of said chamber. The waste input means may comprise an air lock means comprising a loading chamber for isolating a predetermined quantity of said waste sequentially from an inside of said chamber and from an outside of said chamber.

The apparatus may also further comprise waste composition determination means for at least partially determining a composition of waste fed to the said chamber, and the waste composition determination means is operatively connected to said control means.

The apparatus may further optionally comprise a second decongestion system for decongesting waste within said waste converting apparatus, said system comprising:— at least one fluxing agent inlet means in said chamber separate from said waste inlet means, for selectively providing at least a quantity of at least one fluxing agent to a lower part of said chamber for at least partially removing a solid deposition type congestion and/or high viscosity liquid product-type congestion from said chamber, and/or to substantially prevent occurrence or propagation of such a congestion;

at least one said liquid product level sensing means at least for detecting a third predetermined status of a liquid product level in said chamber;

said at least one fluxing agent inlet means being selectively operable at least in response to said predetermined third status being detected.

Typically, the third predetermined status corresponds to a detected liquid product level substantially greater than a predetermined maximum, and the liquid level sensing means is adapted for selectively detecting said second status or said third status of liquid product level. At least one fluxing agent inlet means is located intermediate between said at least one liquid products outlet means and said waste inlet means. At least one fluxing agent inlet means may be located intermediate between said primary plasma torch means and said waste inlet means. Optionally, the fluxing agent inlet means may be vertically spaced from said primary plasma torch means by a predetermined spacing such as to enable a fluxing agent provided to said chamber via said fluxing agent inlet means to be substantially melted by means of said primary torch means. The fluxing agent inlet means is operatively connected to at least one suitable source of fluxing agent.

The second decongestion system advantageously also comprises at least one secondary plasma torch means having an outlet in said chamber such that during operation of said system a high temperature zone may be selectively provided within said converting chamber such as to enable a fluxing agent provided to said chamber via said fluxing agent inlet means to be substantially melted by means of said secondary torch means. Optionally, the fluxing agent inlet means and the second plasma torch means are disposed in a mixing chamber in communication with said chamber.

The fluxing agent may be provided in powdered form or in granulated form, and may include $SiO_2$ (or sand), CaO (or $CaCO_3$), MgO, $Fe_2O_3$, $K_2O$, $Na_2O$, $CaF_2$, borax, dolomite, or any other suitable fluxing material including any suitable composition comprising at least one suitable fluxing material.

The present invention is also directed to a method for decongesting an apparatus for converting waste, wherein said apparatus comprises a waste converting chamber adapted for accommodating a column of waste;

at least one primary plasma torch means for generating a hot gas jet at an output end thereof and for directing said jet towards a lower longitudinal part of the chamber;

at least one liquid product outlet means at a lower longitudinal part of said chamber;

wherein said method comprises:—

(a) providing at least one secondary plasma torch means having an outlet in said chamber such that during operation of said system a high temperature zone may be selectively provided within said converting chamber for at least partially removing a bridge-type congestion from said chamber and/or to substantially prevent occurrence or propagation of such a congestion;

(b) monitoring the flow rate of waste within said chamber via suitable waste flow rate sensing means;

(c) monitoring the level of liquid products at a lower longitudinal part of said apparatus via suitable liquid product level sensing means;

(d) if the volume flow rate at (b) decreases below a predetermined minimum and the level at (c) does not substantially increase above a predetermined maximum value, operating at least one said second plasma torch means;

(e) maintaining operation of said secondary plasma torch means until the waste flow rate at (b) is substantially restored to its predetermined minimum or until the level at (c) is substantially restored to its predetermined maximum, whereupon steps (b) to (e) are repeated.

Optionally, at least one said secondary plasma torch in step (a) may be provided at a lower portion of said chamber and at least one other said secondary plasma torch is provided at an upper part of said chamber with respect to said lower portion, and wherein steps (d) and (e) are replaced with the following steps:—

(f) if the volume flow rate at (b) decreases below a predetermined minimum and the level at (c) does not substantially increase above a predetermined maximum value, operating at least one said second plasma torch means at said lower end of said chamber according to a first operating mode;

(g) if the volume flow rate at (b) is still below said predetermined minimum and the level at (c) has not substantially increased above said predetermined maximum value, operating at least one said second plasma torch means at said upper part of said chamber;

(h) maintaining operation of said secondary plasma torch means at the upper part of said chamber until the waste flow rate at (b) is substantially restored to its predetermined minimum or until the level at (c) is substantially restored to its predetermined maximum, whereupon steps (b), (c), (f), (g) and (h) are repeated.

The first operating mode may comprise activating the said at least one secondary plasma torch at said lower end of said chamber for a predetermined time interval and then deactivating the same.

The method may further comprise providing the apparatus with at least one fluxing agent inlet means in said chamber separate from said waste inlet means, for selectively providing at least a quantity of at least one fluxing agent to a lower part of said chamber for at least partially removing a solid deposition type congestion and/or high viscosity liquid product-type congestion from said chamber, and/or to substantially prevent occurrence or propagation of such a congestion, said method further comprising the steps;

(i) if the level at (c) substantially increases above said predetermined maximum value, operating at least one said second plasma torch means at said lower end of said chamber according to a second operating mode;

(j) if the level at (c) has not decreased to at least said predetermined maximum value, operating at least one said second plasma torch means at said upper part of said chamber;

(k) providing a predetermined quantity of at least one fluxing agent to chamber via said fluxing agent inlet means until the level at (c) is substantially restored to its predetermined maximum, whereupon steps (b), (c), (i), (0) and (k) are repeated.

Preferably, the second operating mode comprises activating the said at least one secondary plasma torch at said lower end of said chamber for a predetermined time interval and then deactivating the same.

DISCLOSURE OF INVENTION

Figure 1:
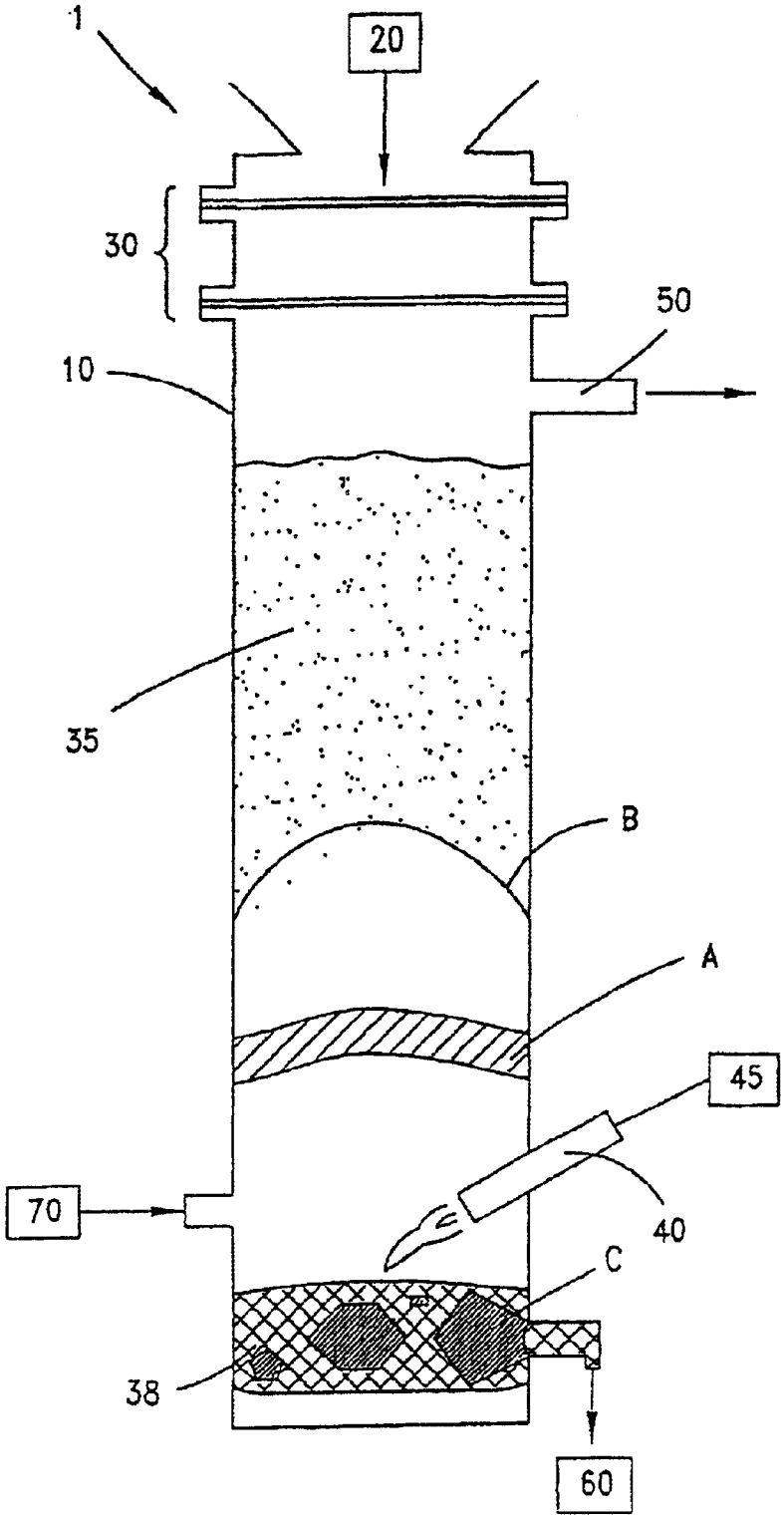
FIG. 1 shows schematically the general layout and main elements of a typical solid/mixed waste plasma processing apparatus of the prior art.

The present invention is defined by the claims, the contents of which are to be read as included within the disclosure of the specification, and will now be described by way of example with reference to the accompanying Figures.

The present invention relates to a system for maintaining decongested a waste converting apparatus, primarily by removing congestions when they occur, but also by providing preventative action. The term "waste converting apparatus" herein includes any apparatus adapted for treating, processing or disposing of any waste materials, including municipal waste, household waste, industrial waste, medical waste, nuclear waste and other types of waste. The present invention is also directed to such waste converting apparatus having the aforesaid system, and to methods of operating such systems and apparatuses. The apparatus typically comprises a waste converting chamber adapted for accommodating a column of waste, at least one primary plasma torch means for generating a hot gas jet at an output end thereof and for directing said jet towards a bottom longitudinal part of the chamber. The waste converting apparatus may further comprise at least one gas outlet means at an upper longitudinal part of the chamber, and at least one liquid product outlet at a lower longitudinal part of the chamber.

In its simplest form, and in a first aspect of the present invention, the system for decongesting waste comprises:— at least one waste flow rate sensing means at least for detecting a first predetermined status of a flow rate of waste in said chamber;

at least one liquid product level sensing means at least for detecting a second predetermined status of a liquid product level in said chamber;

at least one secondary plasma torch means having an outlet in said chamber such that during operation of said system a high temperature zone may be selectively provided within said converting chamber for at least partially removing a bridge-type congestion from said chamber and/or to substantially prevent occurrence or propagation of such a congestion;

said secondary plasma torch means being selectively operable at least in response to said predetermined first status and said predetermined second status being detected.

In a second aspect of the present invention, the system for decongesting waste comprises:— at least one fluxing agent inlet means in said chamber separate from said waste inlet means, for selectively providing at least a quantity of at least one fluxing agent to a lower part of said chamber for at least partially removing a solid deposition type congestion and/or high viscosity liquid product-type congestion from said chamber, and/or to substantially prevent occurrence or propagation of such a congestion;

at least one said liquid product level sensing means at least for detecting a third predetermined status of a liquid product level in said chamber;

said at least one fluxing agent inlet means being selectively operable at least in response to said predetermined third status being detected.

Figure 2:
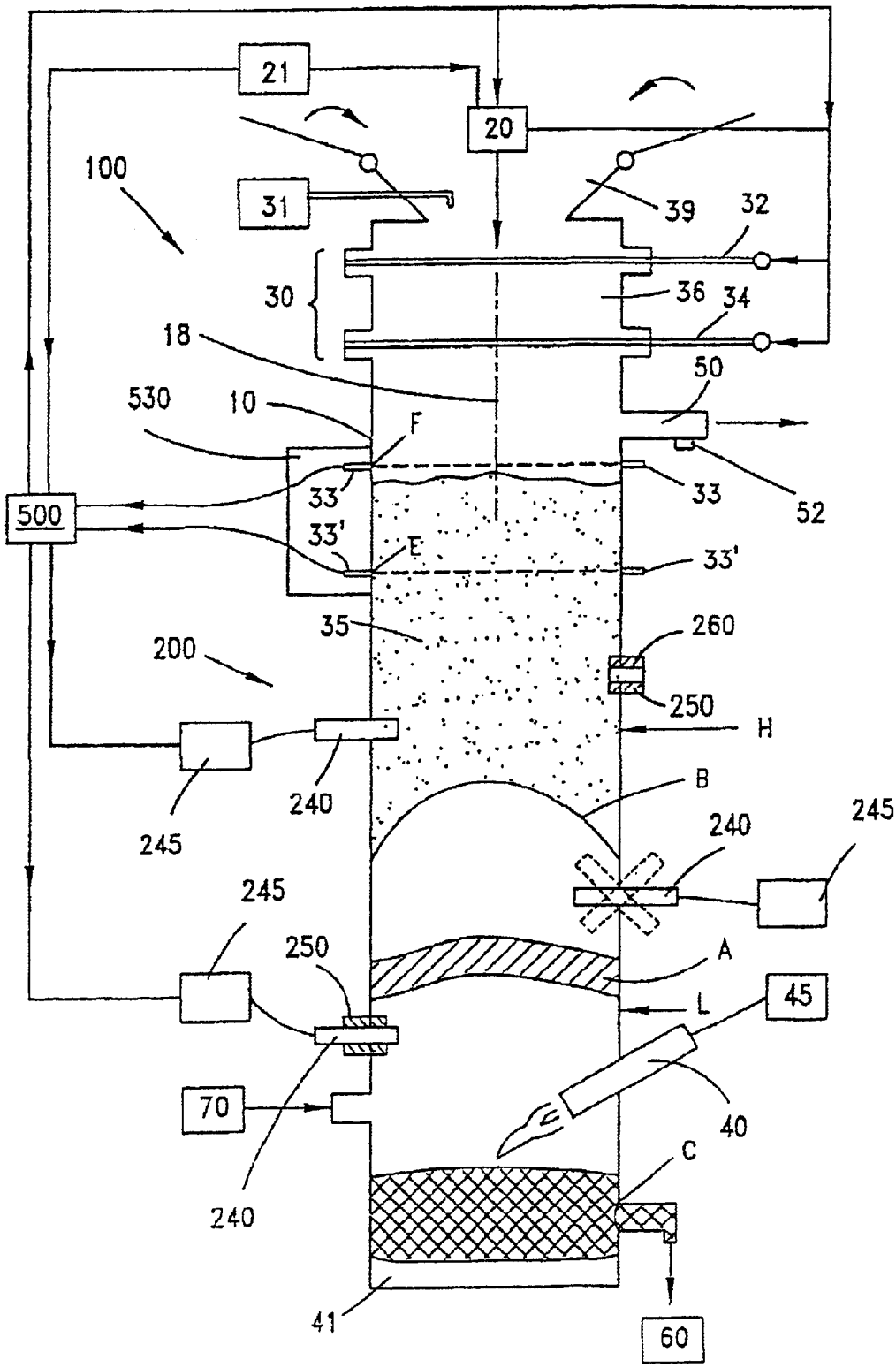
FIG. 2 shows schematically the main elements of the first aspect of the present invention in relation to a typical plasma processing apparatus.
Figure 3:
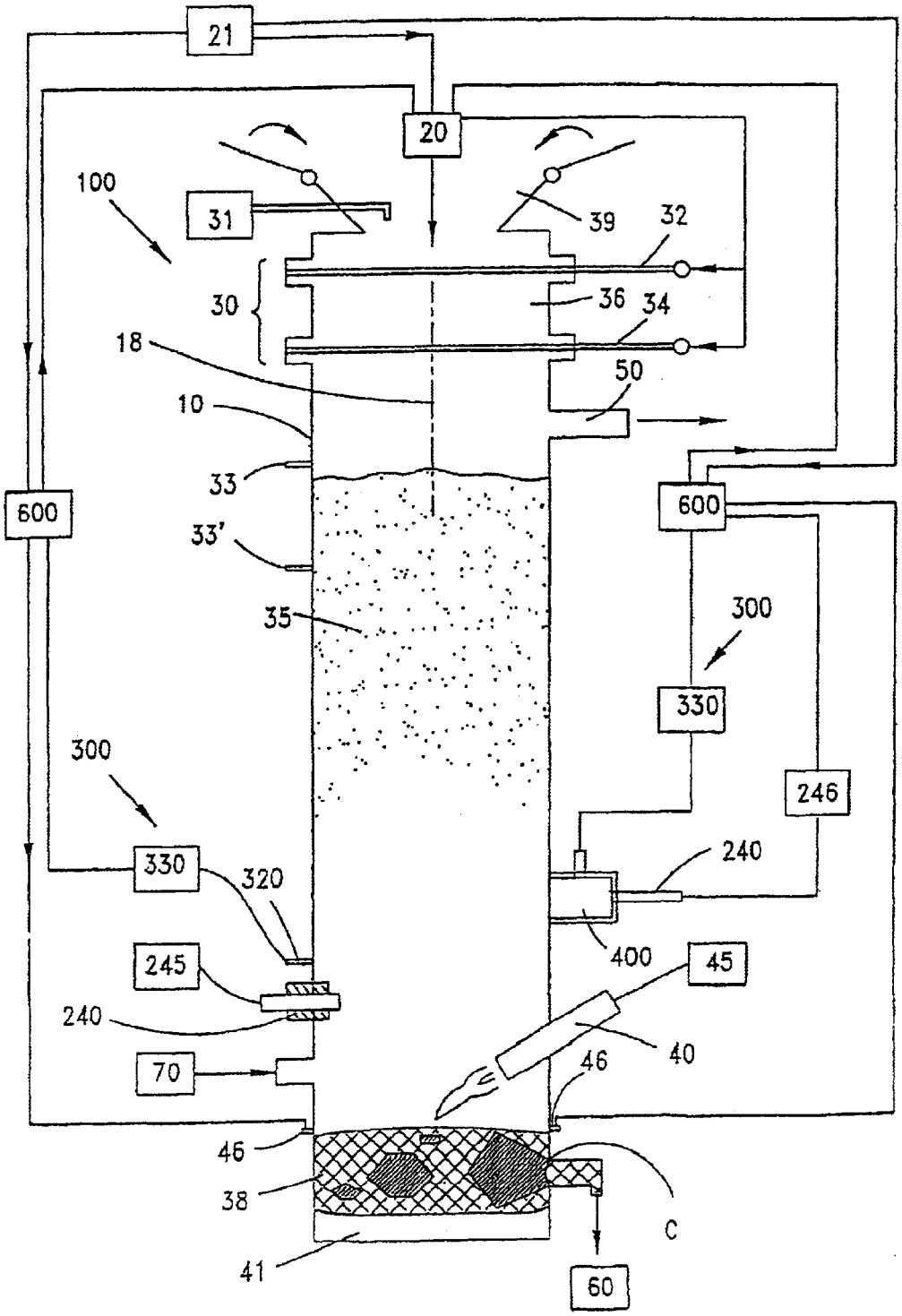
FIG. 3 shows schematically the main elements of the second aspect of the present invention in relation to a typical plasma processing apparatus.

Referring to the Figures, FIGS. 2 and 3 illustrates a preferred embodiment of the present invention according to the first aspect and second aspect thereof, respectively. The plasma waste processing apparatus, designated by the numeral (100), comprises a processing chamber (10), which while typically is in the form of a cylindrical or frusto-conical vertical shaft, may be in any desired shape. Typically, a solid or mixed waste feeding system (20) introduces typically solid waste at the upper end of the chamber (10) via a waste inlet means comprising an air lock arrangement (30). Mixed waste may also be fed into the chamber (10), though generally gaseous and liquid waste is removed from the apparatus (10) without substantial treatment. The solid/mixed waste feeding system (20) may comprise any suitable conveyor means or the like, and may further comprise a shredder for breaking up the waste into smaller pieces. The air lock arrangement (30) may comprise an upper valve (32) and a lower valve (34) defining a loading chamber (36) therebetween. The valves (32), (34) are preferably gate valves operated electrically, pneumatically or hydraulically to open and close independently as required. A closeable hop arrangement (39) funnels typically solid and/or mixed waste from the feeding system (20) into the loading chamber (36) when the upper valve (32) is open, and the lower valve (34) is in the closed position. Feeding of waste into the loading chamber (36) typically continues until the level of waste in the loading chamber (36) reaches a predetermined point below full capacity, to minimise the possibility of any waste interfering with closure of the upper valve (32). The upper valve (32) is then closed. In the closed position, each of the valves (32), (34) provides an air seal. When required, the lower valve (34) is then opened enabling the waste to be fed into the processing chamber (10) with relatively little or no air being drawn therewith. The opening and closing of the valves (32), (34), and the feeding of waste from the feeder (20) may be controlled by any suitable controller (500), which may comprise a human controller and/or a suitable computer system operatively connected thereto and to other components of the apparatus (100). Preferably, a waste flow sensing system (530) is provided and operatively connected to the controller (500). The sensing system (530) typically comprises one or more suitable sensors (33) at an upper part or level (F) of the chamber (10) for sensing when the level of waste reaches this level. Similarly, the sensing system (530) typically also comprises one or more suitable sensors (33') at a level (E), vertically displaced downwards with respect to level (F) of the chamber (10), for sensing when the level of waste reaches this level. Level (F) may advantageously represent the maximum safety limit for waste in the chamber (10), while level (E) may represent a level of waste within the chamber (10) at which it is efficient to provide more waste to the chamber (10). Thus, the volume in the chamber (10) between level (E) and level (F) may be approximately equal to the volume of waste that may be accommodated in loading chamber (36). Alternatively, or additionally, the location of the sensors (33) and (33') at levels (F) and (E) may be chosen to provide suitable datums for determining an actual flow rate of the waste through the chamber (10) by measuring the time interval between the time when the level of waste is at level (F) to when it reaches level (E), for example. The controller (500) may also be operatively connected to valves (32), (34) to coordinate loading of the loading chamber (36) from the feeding system (20), and unloading of the waste from the loading chamber (36) to the processing chamber (10).

Optionally, the hop arrangement (39) may comprise a disinfectant spraying system (31) for periodically or continuously spraying the same with disinfectant, as required, particularly when medical waste is being processed by apparatus (100).

The processing chamber (10) is typically, but not necessarily, in the form of a cylindrical shaft having a substantially vertical longitudinal axis (18). The inner part of processing chamber (10) in contact with the waste column (35) is typically made from suitable refractory material, and has a bottom end comprising a liquid product collection zone (41), typically in the form of a crucible, having at least one outlet associated with one or more collection reservoirs (60). The processing chamber (10) further comprises at the upper end thereof at least one primary gas outlet (50) for collecting primarily product gases from the processing of waste. The upper end of the processing chamber (10) comprises the said air lock arrangement (30), and the processing chamber (10) is typically filled with waste material via the airlock arrangement (30) up to about the level of the primary gas outlet (50). Sensing system (530) senses when the level of waste drops sufficiently (as a result of processing in the chamber (10)) and advises controller (500) to enable another batch of waste to be fed to the processing chamber (10) via the loading chamber (36). The controller (500) then closes lower valve (34) and opens upper valve (32) to enable the loading chamber (36) to be re-loaded via feeding system (20), and then closes upper valve (32), ready for the next cycle.

One or a plurality of primary plasma torches (40) at the lower end of the processing chamber (10) are operatively connected to suitable electric power, gas and water coolant sources (45), and the plasma torches (40) may be of the transfer or non-transfer types. The torches (40) are mounted in the chamber (10) by means of suitably sealed sleeves, which facilitates replacing or servicing of the torches (40). The torches (40) generate hot gases that are directed downwardly at an angle into the bottom end of the column of waste. The torches (40) are distributed at the bottom end of the chamber (10) such that in operation, the plumes from the torches (40) heat the bottom of the column of waste, as homogeneously as possible, to a high temperature, typically in the order of about 1600° C. or more. The torches (40) generate at their downstream output ends hot gas jets, or plasma plumes, having an average temperature of about 2000° C. to about 7000° C. The heat emanating from the torches (40) ascends through the column of waste, and thus a temperature gradient is set up in the processing chamber (10). Hot gases generated by the plasma torches (40) support the temperature level in the chamber (10) which is sufficient for continuously converting the waste into product gases that are channeled off via outlet (50), and into a liquid material (38) that may include molten metal and/or slag, which may be periodically or continuously collected at the lower end of the chamber (10) via one or more reservoirs (60).

Oxidising fluid (70), such as air, oxygen or steam may be provided at the lower end of the chamber (10) to convert carbon, produced in the processing of organic waste, into useful gases such as CO and $H_2$, for example.

The apparatus (100) may further comprise a scrubber system (not shown) operatively connected to the outlet (50), for removing particulate matter and/or other liquid droplets (including pitch), as well as any undesired gases (such as HCl, $H_2S$, HF, for example) from the product gas stream leaving the chamber (10) via outlet (50). Particulate matter may include organic and inorganic components. Pitch may be contained in the gas stream leaving outlet (50) in gas or liquid form. Scrubbers capable of performing such tasks are well known in the art and do not require to be further elaborated upon herein. The scrubber is typically operatively connected downstream thereof to a suitable gas processing means (not shown) such as a gas turbine power plant or a manufacturing plant, for example, for economically utilising the cleaned product gases, typically comprising at this stage $H_2$, CO, $CH_4$, $CO_2$ and $N_2$. The scrubber may further comprise a reservoir (not shown) for collecting particulate matter, pitch and liquid matter removed form the gas products by the scrubber. Such particulate matter and liquid matter (including pitch) require further processing.

Optionally, the apparatus (100) may further comprise an afterburner (not shown) operatively connected to the outlet (50) for burning organic components in the product gases and connected to suitable afterburner energy utilisation systems and also to off-gas cleaning systems (not shown). Such energy utilisation systems may include a boiler and steam turbine arrangement coupled to an electric generator. Off-gas cleaning systems may produce solid waste materials such as fly ash with reagents, and/or liquid solutions comprising waste materials which require further processing.

In a first aspect of the present invention, and referring particularly to FIG. 2, at least a first chamber decongestion system (200) is provided for the removal of, and also for the prevention of the formation of, bridging phenomena within the chamber (10), thereby leading to a smoother and continuous operation of the plasma waste processing apparatus (100).

Referring to FIG. 2, in the preferred embodiment of the present invention, the first decongestion system (200) according to the first aspect thereof comprises at least one secondary plasma torch (240) situated within the chamber (10) between an upper portion of the chamber (10), and the primary plasma torches (40), and preferably between the gas outlet (50) and the primary plasma torches (40). More preferably, the system (200) comprises at least one secondary plasma torch (240) located within a lower longitudinal third of the chamber (10) taken vertically between the primary torch means (40) and the gas outlet means (50). Each secondary plasma torch (240) is operatively connected to suitable electric power, gas and water coolant sources (245), and the secondary plasma torches (240) are typically of the non-transfer types. The secondary plasma torches (240) are typically mounted in the chamber (10) by means of suitably sealed sleeves (250), which facilitate replacing or servicing of the torches (240). The torches (240) generate hot gases that may be directed towards a bridging formation (B) or (A) occurring within the column of waste. The secondary torches (240) are distributed within the chamber (10) such that in operation, the plumes from the torches (240) provide a high temperature heat blast, typically in the order of about 1600° C. or more, to the bridge formation (A) or (B) to disrupt, destroy or melt the same. As with the primary plasma jets (40), the secondary plasma torches (240) generate at their downstream output ends hot gas jets, or plasma plumes, having an average temperature of about 2000° C. to about 7000° C. Additionally, the air or oxygen that may be used to operate the secondary plasma torches (240) also enable the oxidation of charcoal within the waste column (35). This exothermic process leads to a further increase in temperature within the chamber (10).

Typically, and in contrast to the normal operation of the primary torches (40), the secondary torches (240) are only operated when a bridge phenomenon is in the process of forming, or is in fact already formed. Thus, rather than being operated continuously, the secondary torches (240) need only be used as and when required. Thus, the secondary torches (240) are subject to relatively less wear than the primary torches (40), and need relatively less maintenance. Alternatively, the secondary torches (240) may also be used intermittently preventively, providing a heat blast to the refuse column (35) at preset intervals, which may be determined statistically, for example, thereby preventing the formation of bridging phenomena. In any case, the secondary plasma torches (240) are preferably operatively connected to and thus controlled via, controller (500).

Bridging phenomena of type (A) caused by vitrification or bituminisation are generally formed at the lower end of the chamber (10), and thus, one or more secondary torches (240) may be provided at this end to deal with such bridging phenomena. Bridging phenomena of type (B) are generally caused naturally by the downflow of solids, and its most likely location along the height of the chamber (10) may be estimated or empirically determined. The exact location, though, may depend on the average particle size and general homogeneity of the waste column (35). Accordingly, further secondary plasma torches (240) may be provided at such locations to deal with such bridging phenomena.

Thus, a plurality of secondary torches (240) may be provided to chamber (10) at various heights disposed between the primary torches (40) and the gas outlet (50). The secondary plasma torches (240) may be distributed within the chamber (10) longitudinally and/or circumferentially. For example, one or more lower secondary torches (240) may be provided near the lower end of the chamber (10), but at a height above the primary torches (40), say at location (L) in FIG. 2, typically within the lower third of the chamber (10) taken vertically between the primary plasma torches (40) and the gas outlet (50). Similarly, one or more further upper secondary torches (240) may be provided between the lower secondary torches (240) and the gas outlet (50), say at location (H) in FIG. 2, typically within the middle third of the chamber (10). Similarly, more secondary torches may be provided at any desired height along chamber (10). Advantageously, the plurality of secondary torches (240) are also preferably angularly distributed with respect to the periphery of the chamber (10), i.e., viewed along the axis (18). Such a distribution of secondary torches (240) enables the temperature profile within the chamber (10) to be modified when required to remove bridging phenomena wherever they may occur within the chamber (10).

Since not all secondary plasma torches (240) are necessarily used with the same frequency, the chamber (10) may be provided with at least one and preferably a plurality of application points (260) which are adapted for receiving a secondary plasma torch (240) and thus comprises a suitable sleeve (250) which can be selectively sealed to preventing communication between the chamber (10) and the outside when not needed. The apparatus may be provided with a plurality of said application points (250) distributed longitudinally and/or circumferentially with respect to the chamber (10). Thus, application points (260) may be provided at locations within the chamber (10) at which bridging phenomena occur relatively less frequently, or indeed at any other desired location, such that if a bridge is formed near such locations, a secondary plasma torch (240) may be inserted into the chamber via the sleeve (250) at the application point (260), and subsequently removed after dealing with the bridging phenomena. Thus, rather than providing numerous secondary plasma torches (240), the chamber (10) may be provided with a plurality of application points (260), each of which is provided with a secondary plasma torch (240) only when needed. This leads to less wear of the torches (240), as well as lower capital outlay for them. The application points (260) may be provided with means for operatively connecting the secondary torches (240) (when located therein) to the controller (500), or alternatively to an auxiliary control system for enabling these secondary torches to be actuated independently of controller (500).

Additionally or alternatively, some of the secondary torches (240) at least may be adapted for swivelling within the chamber, as illustrated at (240') in FIG. 2, to provide a greater geometric operating envelope therefor within the chamber (10).

Preferably, at least one of the secondary torches (240) may be provided at the lower end of the chamber to increase the temperature thereof and thus alter the temperature profile within the chamber (10) such inorganic waste is melted quickly, and that organic waste is converted to charcoal quickly without allowing it to stay as bitumen for long. While such a configuration can thus be used as a curative feature to remove bridging phenomena, it may also be used in a preventative fashion, the secondary torches (240) being operated periodically (and in some cases perhaps continuously) in order to prevent bridging phenomena from forming in the first place.

The presence of bridging phenomena within the chamber (10) may be indicated by the detection of a significant decrease in the flow rate of waste through the chamber (10), measured by the sensing system (530). Such a decrease may be relatively sharp, and may be manifested by the level of waste in the processing chamber (10) being substantially stationary or taking too long to reach level (E), for example. Thus, when controller (500) receives a signal from upper sensors (33) of the sensing system (530) indicating that the level of waste is at level (F), the controller (500) then expects the level of waste to reach level (E) within a predetermined time period after this event. This predetermined time period is typically correlated with the rate of processing of waste within the chamber (10) of a volume of waste corresponding to the volume of the chamber between level (F) and level (E). As such, the predetermined time period will depend on the composition of the waste previously provided to the chamber (10) and which is now lower down being processed. Determining the composition of the waste is not a straightforward task, and may require visual inspection of the waste before it is provided to the loading chamber (36), or, it may be decided to operate the apparatus with certain types of waste only at certain times. Thus, the predetermined time period may have to be quite large to take account of the possibility that the composition of waste within the chamber (10) is strongly biased towards inorganic waste, for example, and this is causing a slowing down of the pyrolysis waste disposal process in the chamber (10), longer than predetermined.

In other words, the level of the waste column within the chamber (10) may remain substantially stationary or decrease very slowly (while no new waste is added thereto), and this is determined by the controller (500). (In some cases, the waste level may be stuck at the upper point, i.e., at level (F), and thus the controller (500) is also adapted to expect the level of waste to at least fall from (F) within the same or different time period.)

The presence of bridging phenomena is generally also accompanied by a reduction in the amount of output or product gases produced, and of the amount of liquid product produced, since less waste is being processed due to the congestion in the waste column (35). The decrease in production of product gases may be determined by monitoring the flow rate of the product gases through the gas outlet (50). However, there are a number of difficulties associated with this. Firstly, product gases may contain high levels of tar, particulate solids and also liquid vapours, rendering any flow measurement inaccurate. Secondly, while the product gas output may be down (also due to the fact that it is also more difficult for gases to flow upwards in the chamber (10) due to the bridging phenomena), the oxidising gases are still being provided at the lower end of the chamber (10), and these gases are also exhausted via the outlet (50).

The reduction in the production rate of liquid product may be determined by detecting a reduction in the level of liquid product at the liquid product collection zone (41). This is usually a better indicator of the presence of bridging than monitoring the flow rate of liquid product to the reservoirs (60), since if the liquid product has high viscosity and/or solid deposition has occurred, the output of liquid product to the reservoirs (60) will also be decreased or stopped altogether. However, there may also be cases in which notwithstanding having a bridging phenomenon present in the chamber (10), the level of liquid product in the collection zone (41) does not decrease (or at least very slowly) due to high viscosity of the liquid product and/or the presence of solid deposition. Moreover, a lowering of the liquid product level may also be due to the composition of previously processed waste having a relatively low proportion of inorganic waste. Thus, while a lowering of the liquid product level in the collection zone (41) may indicate the presence of bridging, the lack of such this decrease is thus inconclusive. On the other hand, when bridging occurs, it is very unlikely that the level of liquid product will increase. Thus, the preferred parameter in the present invention for monitoring the liquid product for the determination of bridging is whether the level of liquid product in collection zone (41) has increased, providing, in the negative, a necessary though not sufficient condition therefor. For this purpose one or more liquid level detectors (46) are provided to detect whether or not the liquid product level has increased beyond a predetermined level, and the detectors (46) are operatively connected to the controller (500). Such detectors (46) may be simple visual indicators that enable the operator to view directly the liquid level, and may be in the form of a suitable window, for example, located near the collection zone (41).

Figure 5:
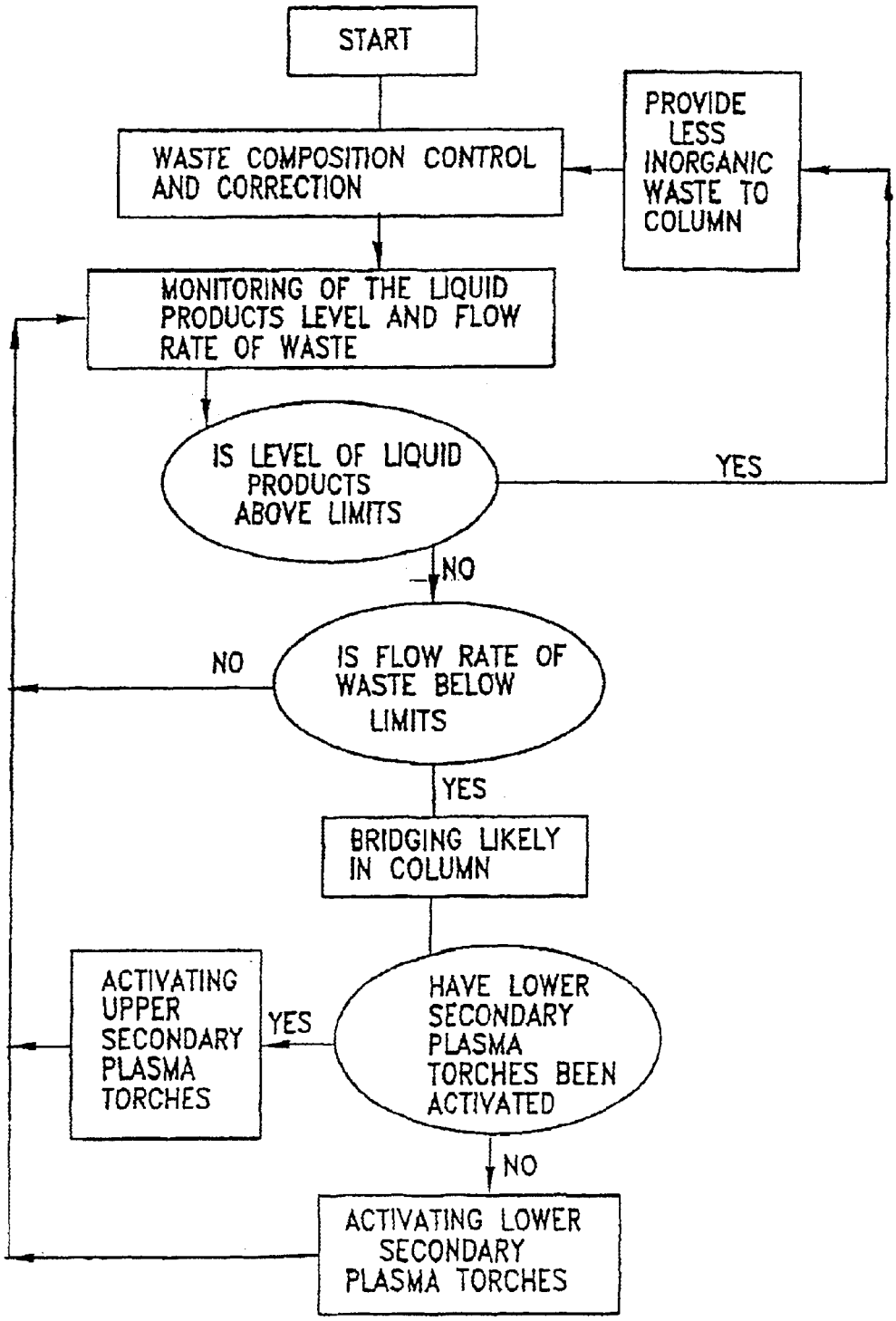
FIG. 5 shows a schematic flow chart illustrating one operating procedure for the decongestant systems of FIG. 2.
Figure 6:
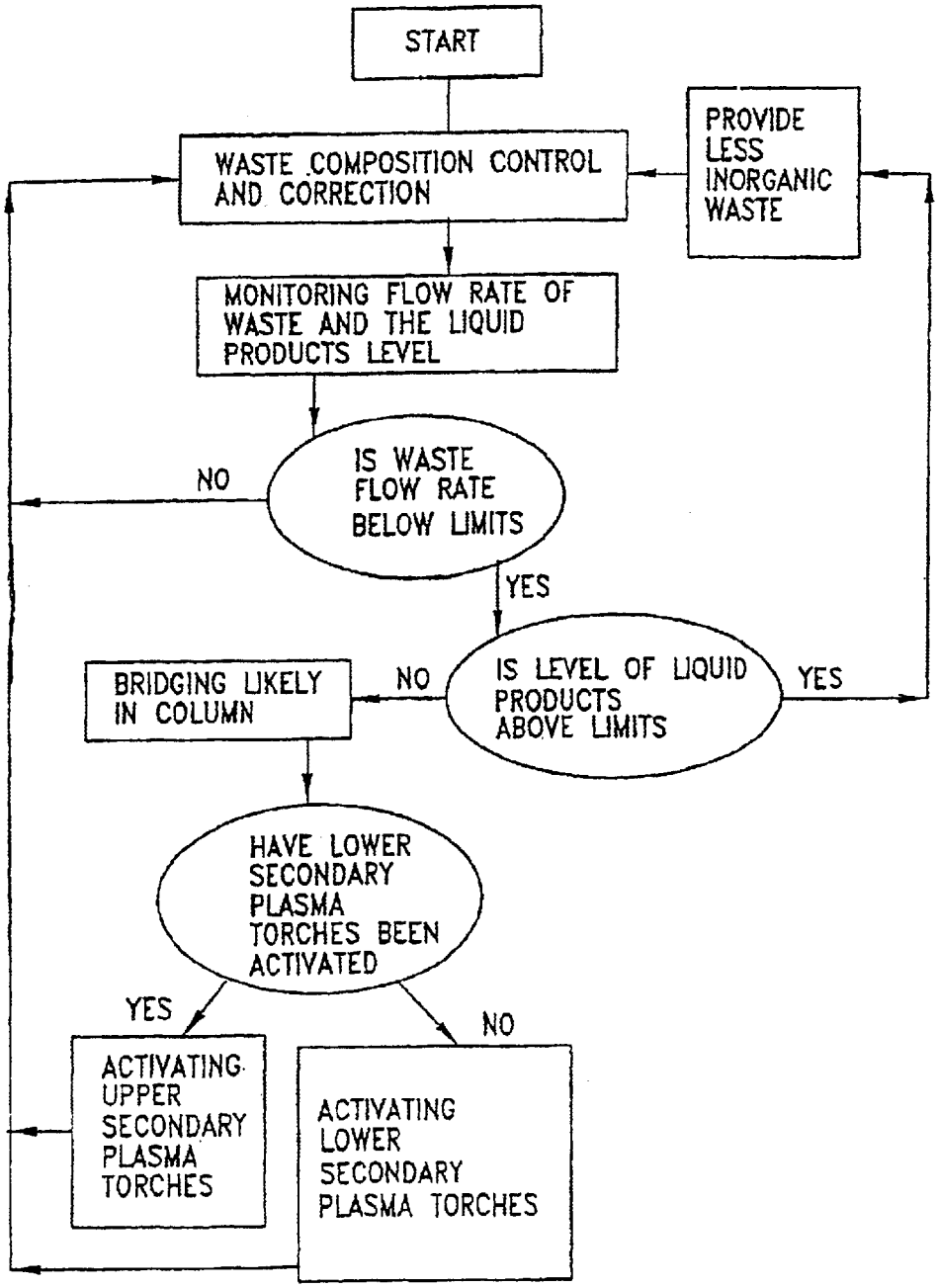
FIG. 6 shows a schematic flow chart illustrating an alternative operating procedure for the decongestant systems of FIG. 2.

Thus, referring in particular to FIGS. 5 and 6, when the controller (500) determines that the waste flow rate through the chamber (10) has been reduced below a predetermined limit as described above, and that the level of the liquid products in the collection zone (41) is not above a predetermined limit, this determination provides a high probability that bridging has in fact occurred within the chamber (10) and corrective action is required.

Since the location of bridging phenomena within the chamber (10) may sometimes be random or quasi-random, the corrective action is preferably by activating the secondary torches (240), preferably in a manner such as to maximise the effectiveness thereof. Thus, in the first instance the lower secondary torches (240), for example as located at (L) in the Figures, are first activated. The temperature of waste material in column (35) will be increased not only because of the additional thermal energy provided by the secondary plasma jets, but also because of exothermic reactions between charcoal and additional oxygen supplied via the secondary torches. The temperature profile within the chamber (10) is thus changed which may enable the bridging phenomena to be overcome. If the temperature profile change is insufficient to overcome the bridging phenomena, the secondary torches (240) provided at the next level, say at (H), above the previous secondary torches are then operated, in addition to or instead of, the latter, and such sequencing of secondary torches continues as necessary up the chamber (10). The sequencing of the secondary torches are preferably controlled by the controller (500), but may instead be controlled by any other suitable controlling means such as a computer for example, to each provide a heat blast of suitable intensity and duration in a predetermined sequence such as that described, for example, along the height and circumference of the chamber (10). In rare cases where the bridging phenomena persist, additional secondary plasma torches (240) may be provided and operated via suitable application points (250). The extent of this activation, in particular how many torches are provided, in which order they are activated, whether continuously or in bursts, and for how long, may be decided according to any suitable plan, which may be modified with time according to experience gained with any particular apparatus (100).

If it is determined that while the waste flow rate through the chamber (10) is below limits, nevertheless the level of liquid products is increasing, this may be indicative of the presence of solid deposition and/or high viscosity liquid product.

If it is determined that the waste flow rate through the chamber (10) is not below limits, i.e., nominal, but nevertheless the level of liquid products is increasing, this is indicative of either (a) that the waste contains a high percentage of inorganic waste; and/or (b) that solid deposition and/or high viscosity of the liquid product is present. Correction action for (a) is relatively simple, requiring the primary torches (40) to be used at a higher rating, for example, and/or for organic waste proportion of the waste to be increased. Corrective action for (b) in addition to, and also independent from, dealing with bridging phenomena, is discussed below. In order to assess the likelihood of either (a) or (b) or a combination of both is the cause of the symptoms detected by controller (500), waste composition determination means (21) are provided to monitor the waste before it is fed into the chamber (10). The simplest form of such means (21) is a visual monitoring means and a human operator thereof to visually scan the waste, which often provides a fair indication of whether the waste is organic-rich or inorganic-rich. Another way to enable the controller (500) to discriminate between cause (a) and cause (b) is by analysis of the product gases flowing out via outlet (50), and/or their flow rate. A lower than normal flow rate of product gases such as $CO_2$, CO, $H_2$ or hydrocarbons, for example, indicates that there may be a high probability of (a).

In a second aspect of the present invention, at least a second chamber decongestion system (300) is provided for the removal of, and also for the prevention of the formation of, unprocessed solid deposition within the chamber (10), and/or for dealing with high viscosity liquid product, thereby leading to a smoother and continuous operation of the plasma waste processing apparatus (100).

Referring to FIG. 3, in the preferred embodiment of the present invention according to the second aspect thereof, the second decongestion system (300) comprises at least one fluxing agent inlet (320) situated within the chamber (10) between the waste inlet means and the liquid product collection zone (41). Preferably, at least one fluxing agent is located between the gas outlet (50) and the liquid product collection zone (41), and more preferably between the gas outlet (50) and the primary plasma torches (40). Each fluxing agent inlet (320) is operatively connected to one or more fluxing agent sources (330) such that any desired fluxing agent may be provided to the chamber (10) at a location near to where unprocessed solids and/or high viscosity liquid products are deposited. The fluxing agents may be provided via inlet (320) preferably in powdered or granulated form, and thus an appropriate feed system, such as for example a worm feed device or a pneumatic feed device (for powdered fluxing agents), is associated with the inlet (320).

Unprocessed solids (C) such as aluminium oxide, or its refractory compositions with other oxides, for example may be deposited at the liquid product collection zone (41) and in fact block the outlet to the collection reservoirs (60). The addition of an appropriate fluxing agent directly to the unprocessed solids (C) enables the solid to be processed, typically by enabling the unprocessed solid to dissolve in the fluxing agent and melt together at a substantially lower melting point than the melting point of the unprocessed solids and thus enabling the solids to melt and leave the chamber (10) to reservoirs (60). This is particularly so if the fluxing agents are in the molten state by the time that they come into contact with the unprocessed solids. Thus, preferably, the fluxing agent inlet means (320) is preferably vertically spaced from the primary plasma torch means (40) by a predetermined spacing such as to enable a fluxing agent provided to the chamber (10) via the fluxing agent inlet means (320) to be substantially melted by means of the heat provided by the primary torch means (40). This predetermined spacing is typically an optimal spacing—a larger spacing provides longer time for the fluxing agent to be heated, but also slows the rate at which the congestion (C) is removed; a shorter spacing does not generally allow enough time for all of the fluxing agent to melt. Thus, the optimal spacing may be different for each fluxing agent used, and thus a practical spacing may be chosen for any given system (300). Similarly, congestion due to slow-moving high-viscosity liquid product at the collection zone (41) may be further processed by suitable fluxing agents and/or heating to reduce viscosity and enable the liquid products to flow out of the chamber (10) and to the reservoirs (60).

Thus, preferably, a secondary plasma torch arrangement may be provided, comprising at least one secondary plasma torch (240) operatively connected to suitable electric power, gas and water coolant sources (245), the secondary plasma torches (240) being typically of the non-transfer types. At least one fluxing agent inlet (320) may be coupled to a secondary plasma torch (240) in a suitable mixing chamber (400), particularly if the fluxing agent is provided in powdered form. The hot plasma jets from the secondary plasma torch (240) also melt the fluxing agents and increase the temperature of the unprocessed solids as well as of the molten material resulting from the processing of the waste column (35). The secondary plasma torches (240) are sufficiently displaced vertically from the collection zone (41) to give the fluxing agent sufficient time to melt before they act on the unprocessed solids.

Additionally, the air or oxygen that may be used to operate the secondary plasma torches (240) also enable the oxidation of charcoal within the waste column (35). This exothermic process leads to a further increase in temperature within the chamber (10).

Particularly when the fluxing agents are not provided in powdered form, but instead in granulated form, the fluxing agent inlet (320) is provided in chamber (10) at a sufficient height above the secondary torches (240) such that when the latter are operated (typically in synchronisation with the introduction of the fluxing agents), a sufficiently high temperature is provided between them to permit the fluxing agents to melt before reaching the unprocessed solids. Thus, at least one fluxing agent inlet (320) may be provided between the pyrolysis and the melting zones of the chamber (10), particularly if the fluxing agent is provided in granulated form, since the fluxing agent has more time to fully melt before acting on the unprocessed solids.

Suitable fluxing agent may include, for example, any one or more from among $SiO_2$ (or sand), CaO (or $CaCO_3$), MgO, $Fe_2O_3$, $K_2O$, $Na_2O$, $CaF_2$, borax, dolomite, or other fluxing material, as well as compositions comprising one or more of these materials.

While the presence of deposited unprocessed solids within the chamber (10) that are blocking passage of liquid product to reservoirs (60) may be accompanied by a relatively slow decrease in the waste throughput flow rate through the chamber (10), it is characterised, rather, by a relatively sharp decrease in the flow rate of liquid product to the reservoirs (60) and in particular by an increase in the level of liquid product (38) within the collection zone (41). Thus, while the presence of unprocessed solids (C) may cause a raise in the level of liquid products in the collection zone (41), it doesn't generally initially affect the processing of the waste column (35), or therefore the flow rate thereof or the amount of product gases produced.

As in the first aspect of the present invention, liquid level detectors (46) at the liquid product collection zone (41) are provided for monitoring the level of liquid product (38) thereat. Referring to FIG. 3, the detectors (46) are operatively connected to a suitable controller (600), which is similar to that described for controller (500) of the first aspect of the present invention, mutatis mutandis. Controller (600) is also operatively connected to the second decongestant system (300) to activate the secondary torches (240) and or to feed any particular fluxing agent via inlets (320) as required, to remove the blockage to the outflow of liquid product caused by the deposited solids and/or high viscosity liquid product. As with the first aspect of the present invention, such detectors (46) may be simple visual indicators that enable the operator to view directly the liquid level, and may be in the form of a suitable window, for example, located near the collection zone (41).

Figure 7:
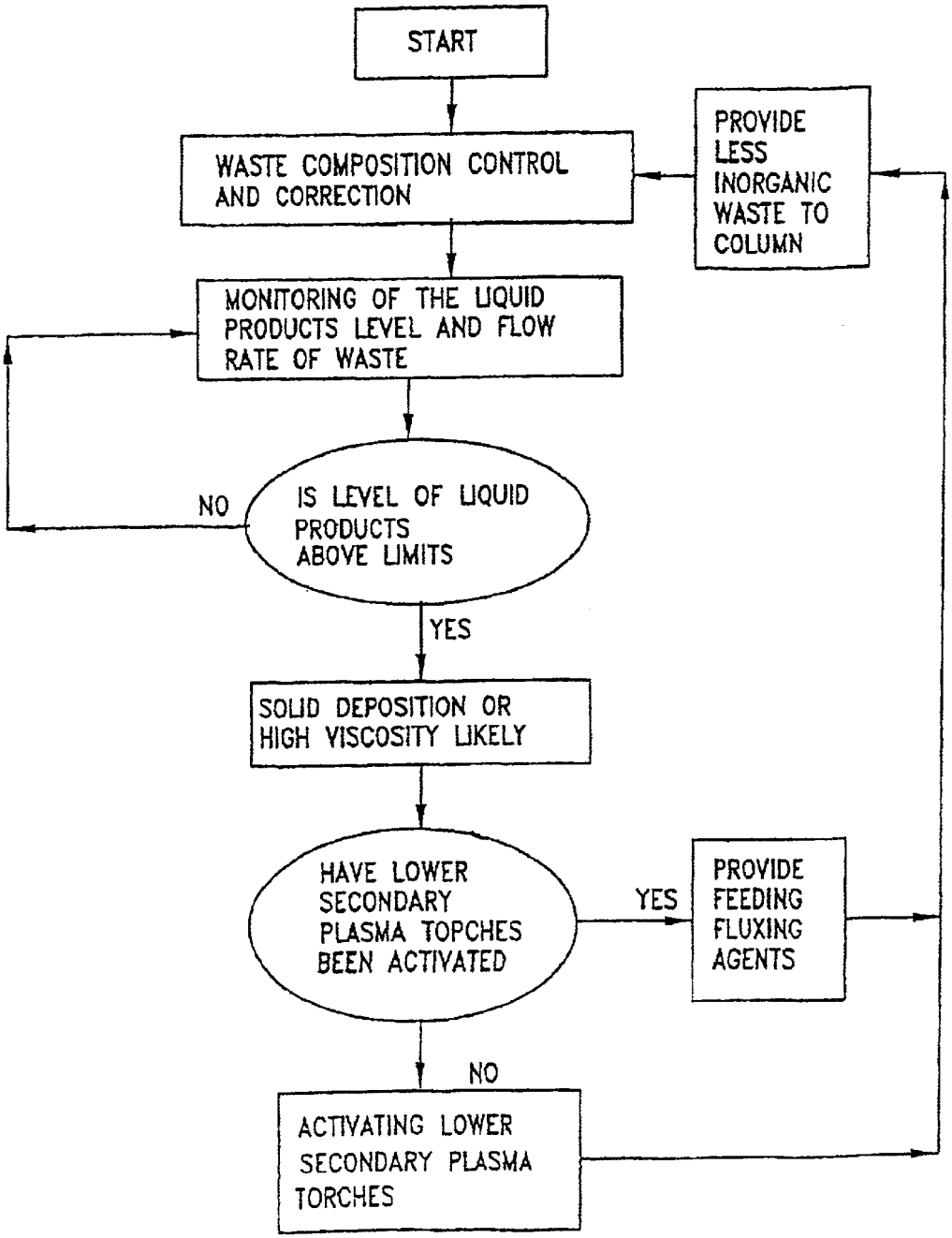
FIG. 7 shows a schematic flow chart illustrating one operating procedure for the decongestant systems of FIG. 3.

Referring to FIGS. 3 and 7, when the controller (600) determines that the level of liquid products (38) in the collection zone (41) is above predetermined limits, this determination provides a high probability that either (a) that the waste contains a high percentage of inorganic waste; and/or (b) that solid deposition and/or high viscosity of the liquid product is present. As discussed in relation to the first aspect of the invention, correction action for (a) is relatively simple, requiring the primary torches (40) to be used at a higher rating, for example, and/or for organic waste proportion of the waste to be increased. In order to assess the likelihood of either (a) or (b) or a combination of both is the cause of the symptoms detected by controller (600), waste composition determination means (21) are also provided to monitor the waste before it is fed into the chamber (10), as described with respect to the first aspect of the invention, mutatis mutandis. Another way to enable the controller (600) to discriminate between cause (a) and cause (b) is by analysis of the product gases flowing out via outlet (50), and/or their flow rate. A lower than normal flow rate of product gases such as $CO_2$, CO, $H_2$ or hydrocarbons, for example, indicates that there may be a high probability of (a).

If it is determined that there is a high probability that (b) is the cause for the symptoms monitored by controller (600), corrective action as follows is provided. Firstly, no more waste is provided to the chamber (10) until nominal conditions are achieved with respect to the liquid product level. In embodiments such as that illustrated in FIG. 3 in which secondary plasma torches (240) are provided, these are first activated, typically via commands received from controller (700). The temperature of waste material in column (35) will be increased, in particular the temperature of the contents of the collection zone (41). The higher temperature may enable any solids deposited in the collection zone (41) to melt, and may reduce the viscosity of liquid products, facilitating their removal therefrom and to the reservoirs (60). If this happens, the level of liquid product drops, eventually to at least the predetermined level, and when this is determined by the controller (600), the secondary torches (240) are deactivated. The extent of this activation, in particular how many torches are provided, in which order they are activated, whether continuously or in bursts, and for how long, may be decided according to any suitable plan, which may be modified with time according to experience gained with any particular apparatus (100). The controller (600) then determines whether or not the temperature increase provided by the secondary torches (240) has been sufficient to overcome the solid deposition/high liquid product viscosity problem. For example, if the liquid product level has not decreased sufficiently in a given time period (which may be variable and depend on factors such as known or suspected composition of the waste, for example), this may be sufficient indication to provide this determination. Thus, when the activation of the secondary plasma torches is not completely effective, or in embodiments not comprising the same, the controller (600) activates the introduction of fluxing agent to the chamber (10) via one or more fluxing inlets (320). Optionally, the secondary torches (240) may also be activated concurrently with the introduction of fluxing agent, in particular in embodiments comprising a said mixing chamber (400).

Figure 4:
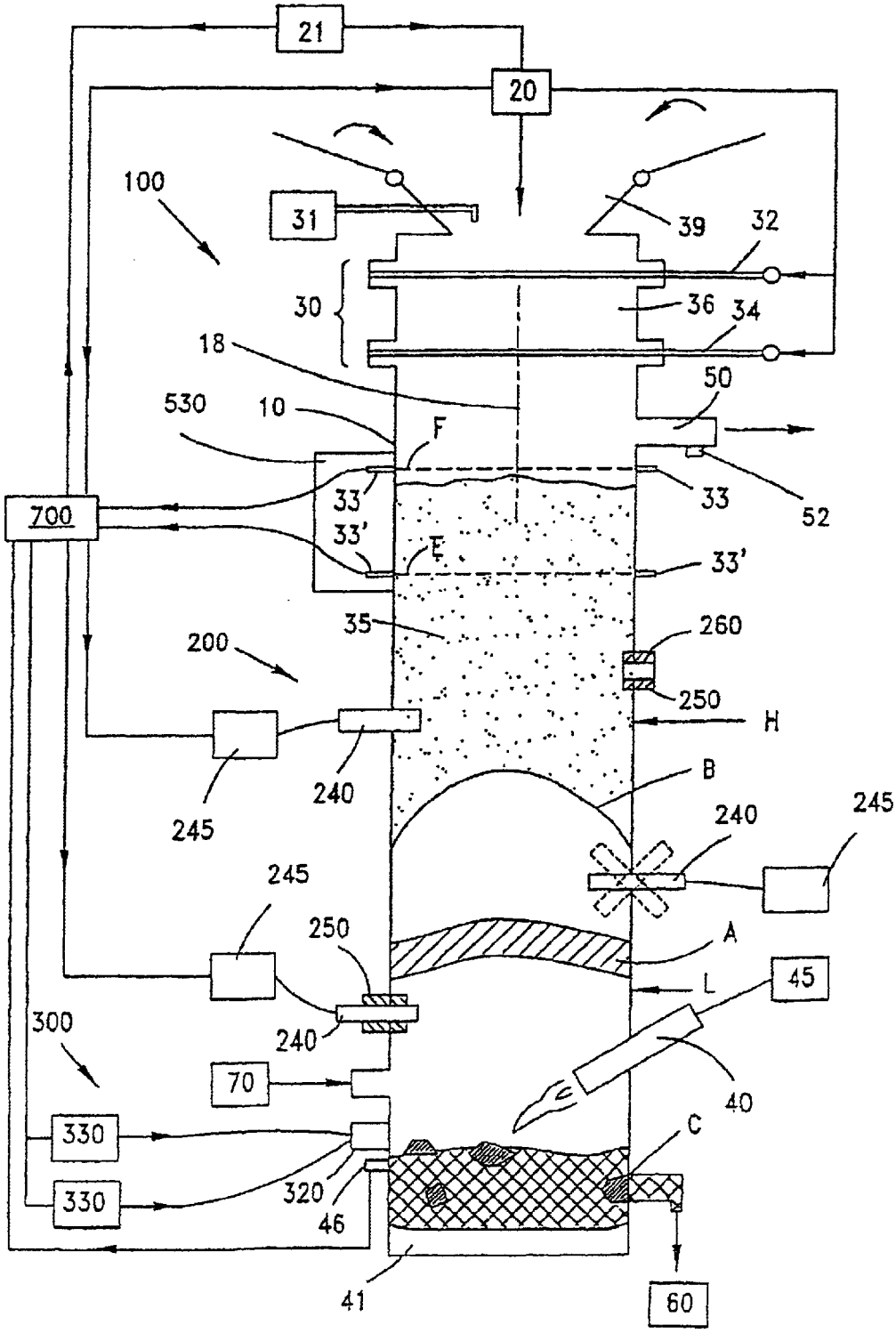
FIG. 4 shows schematically a typical plasma processing apparatus comprising a combination of the decongestion systems shown in FIG. 2 and FIG. 3.

As illustrated in FIG. 4, a third embodiment of the present invention incorporates the flow decongestant systems (200) and (300) according to the first and second aspects, respectively, of the present invention in a common waste disposal apparatus (100). Thus, the third embodiment of the present invention comprises all the components of the preferred embodiments according to the first and second aspects of the invention as described hereinbefore, mutatis mutandis, except that the controller (500) and the controller (600) are replaced by a controller (700) that serves the functions thereof.

The third embodiment may be operated for dealing with bridging phenomena in a manner described with respect to the first aspect of the invention, mutatis mutandis. Similarly, the third embodiment may also be operated for dealing independently with solid deposition/high viscosity liquid products in a manner described with respect to the second aspect of the invention, mutatis mutandis. Preferably, the third embodiment operationally integrates the two operating modes. Thus, referring to FIG. 8, the flow decongestant systems according to the third embodiment may be operated as follows.

In step (I), the composition of the waste is monitored and if necessary adjusted by providing more organic or inorganic waste. In step (II), the level of liquid product is continuously or periodically monitored, typically via sensors (46). In step (IIIa), if the liquid product level is determined by the controller (700) to be above nominal conditions, the controller (700) then determines whether there is a high probability of solid deposition and/or high viscosity liquid product, and if so the second decongestion system may be operated as hereinbefore described with respect to the second aspect of the present invention, mutatis mutandis, (steps (IV) to (VII)). On the other hand, if the liquid product level is not above nominal conditions in step (IIIa), then the waste flow rate through the chamber (10) is continuously or periodically monitored, typically via waste flow rate sensing means (530) (step (IIIb)). If the controller (700) then determines that the flow rate is within predetermined parameters, monitoring of the waste flow rate and liquid products level is continued and the processing of waste continues normally. However, if the controller (700) determines that the waste flow rate has decreased and that at the same time the liquid product level is not above nominal conditions, the controller (700) then determines whether there is a high probability of bridging phenomena having occurred, and if so the first decongestion system may be operated as hereinbefore described with respect to the first aspect of the present invention, mutatis mutandis, (steps (IX) to (XII)).

Figure 8:
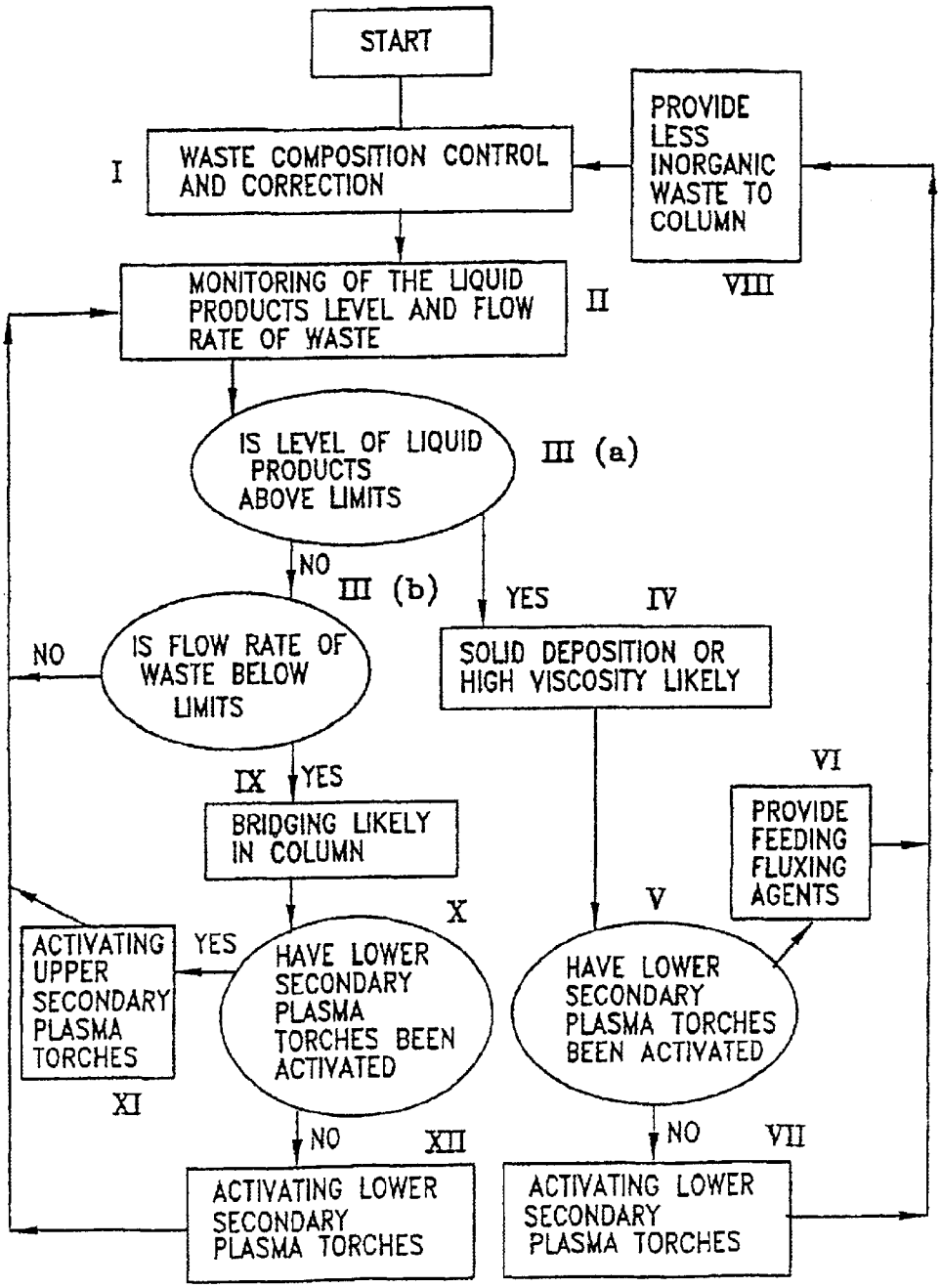
FIG. 8 shows a schematic flow chart illustrating one operating procedure for the decongestant systems of FIG. 4.
Figure 9:
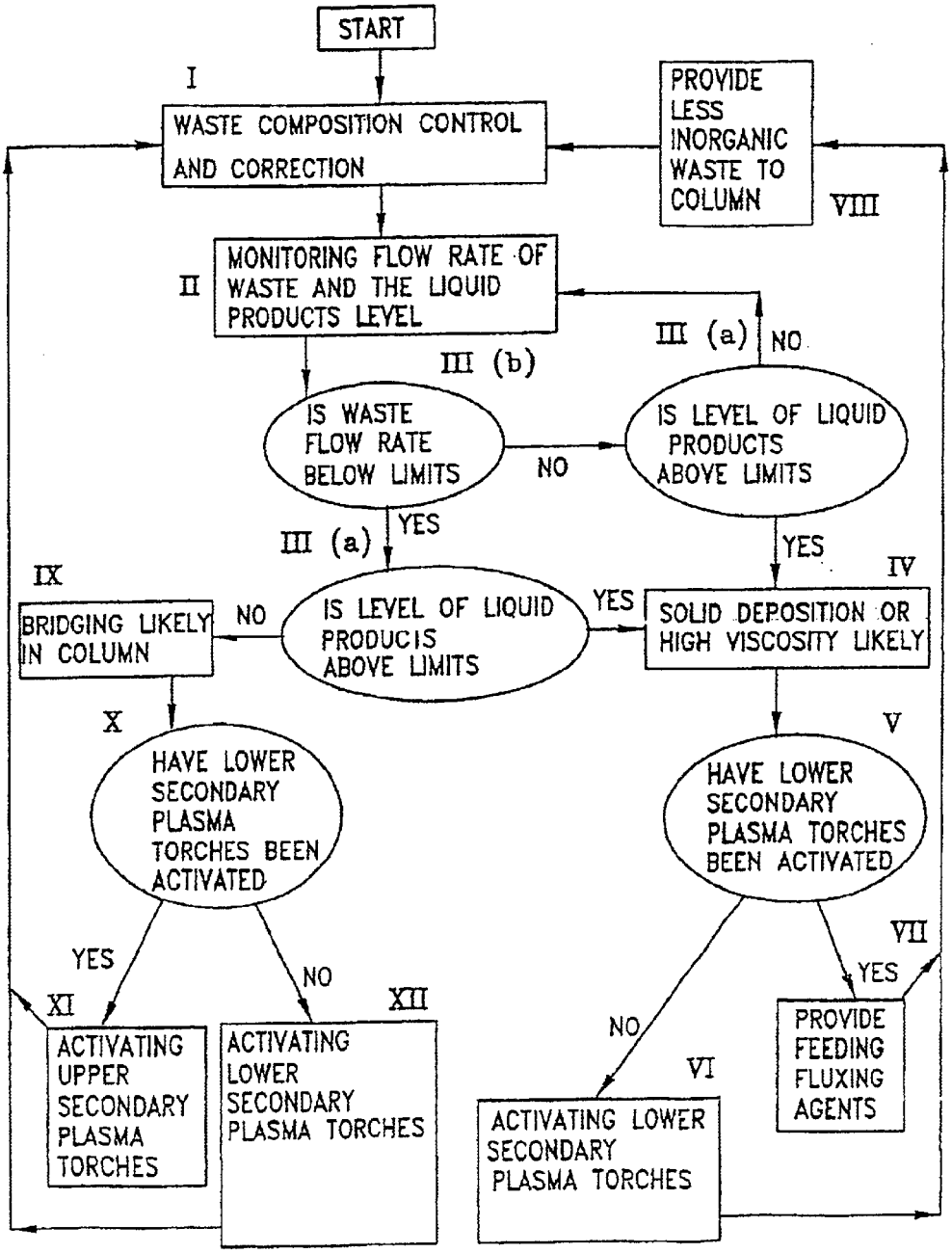
FIG. 9 shows a schematic flow chart illustrating an alternative operating procedure for the decongestant systems of FIG. 4.

In FIG. 9, an alternative operating mode for the third embodiment is illustrated, the main difference between this mode and the operating mode in FIG. 8 being that step (IIIb), monitoring the waste flow rate, is performed before step (IIIa), monitoring the liquid product level.

Alternatively, monitoring of the liquid product level and of the waste flow rate may be continuous, and thus steps (IIIa) and (IIIb) may be combined in a single symptoms-evaluating step.

While the flow decongestant systems according to the first and second aspects are best incorporated as an integral part of a plasma-type mixed waste converter, it is clear that the systems of the present invention are each readily retrofittable, separately or together, on any one of a large number of plasma-based waste converters of the art.

While in the foregoing description describes in detail only a few specific embodiments of the invention, it will be understood by those skilled in the art that the invention is not limited thereto and that other variations in form and details may be possible without departing from the scope and spirit of the invention herein disclosed.

What is claimed is:

1. A system for maintaining substantially decongested a waste converting apparatus, the waste converting apparatus having a waste converting chamber adapted for accommodating a column of waste, at least one primary plasma torch means for generating a hot gas jet at an output end thereof and for directing said jet towards a bottom longitudinal part of the chamber, said system comprising:— at least one waste flow rate sensing means at least for detecting a first predetermined status of a flow rate of waste in said chamber;

at least one liquid product level sensing means at least for detecting a second predetermined status of a liquid product level in said chamber;

at least one secondary plasma torch means having an outlet in said chamber such that during operation of said system a high temperature zone may be selectively provided within said converting chamber for at least partially removing a bridge-type congestion from said chamber and/or to substantially prevent occurrence or propagation of such a congestion;

said secondary plasma torch means being selectively operable at least in response to said predetermined first status and said predetermined second status being detected.

2. A system as claimed in claim 1, wherein said at least one secondary plasma torch means is located intermediate between said primary plasma torch means and an upper portion of said chamber.

3. A system as claimed in claim 1, wherein said waste converting apparatus comprises at least one gas outlet means at an upper longitudinal part of the chamber.

4. A system as claimed in claim 3, wherein at least one said secondary plasma torch means is located within a lower third of the said chamber taken vertically between said primary plasma torch means and said gas outlet means.

5. A system as claimed in claim 4, wherein at least one said secondary plasma torch means is located within a middle third of the said chamber taken vertically between said primary plasma torch means and said gas outlet means.

6. A system as claimed in claim 1, wherein said first predetermined status corresponds to a detected waste flow rate lower than a predetermined minimum.

7. A system as claimed in claim 1, wherein said second predetermined status corresponds to a detected liquid product level not greater than a predetermined maximum.

8. Apparatus for converting waste comprising:—

(One) a waste converting chamber adapted for accommodating a column of waste, said chamber having an upper end;

(Two) at least one primary plasma torch means for generating a hot gas jet at an output end thereof and for directing said jet towards a bottom longitudinal part of the chamber;

(Three) at least one liquid product outlet means at a lower longitudinal part of said chamber;

said apparatus further comprising a first decongestion system as defined in claim 1.

9. Apparatus as claimed in claim 8, comprising a plurality of said second plasma torch means.

10. Apparatus as claimed in claim 9, wherein at least some of said plurality of said second plasma torch means are distributed longitudinally with respect to said chamber.

11. Apparatus as claimed in claim 9, wherein at least some of said plurality of said second plasma torch means are distributed circumferentially with respect to said chamber.

12. Apparatus as claimed in claim 8, further comprising at least one application point adapted for selectively enabling introduction of a plasma torch means with respect to said chamber.

13. Apparatus as claimed in claim 12, wherein each said application point comprising a suitable sleeve for accommodating therein a said second plasma torch such that during operation of said second plasma torch a high temperature zone provided inside the chamber at a predetermined location correlated to said corresponding application point, and wherein said sleeve is selectively sealable to prevent communication between the chamber and the outside when said sleeve is not accommodating a said second plasma torch.

14. Apparatus as claimed in claim 12, comprising a plurality of said application points.

15. Apparatus as claimed in claim 14, wherein at least some of said plurality of said application points are distributed longitudinally with respect to said chamber.

16. Apparatus as claimed in claim 14, wherein at least some of said plurality of said application points are distributed circumferentially with respect to said chamber.

17. Apparatus as claimed in claim 8, further comprising suitable control means for controlling operation of said first decongestion system operative connected to said at least one waste flow rate sensing means, said at least one liquid product level sensing means and said at least one secondary plasma torch means.

18. Apparatus as claimed in claim 8, further comprising at least one suitable gas flow rate sensing means for monitoring the volume flow rate of product gases provided by said apparatus via said gas outlet means.

19. Apparatus as claimed in claim 18, wherein said control means is operatively connected to said gas flow rate sensing means.

20. Apparatus according to claim 8, further comprising waste inlet means associated with said upper part of said chamber.

21. Apparatus as claimed in claim 20, wherein said waste input means comprises an air lock means comprising a loading chamber for isolating a predetermined quantity of said waste sequentially from an inside of said chamber and from an outside of said chamber.

22. Apparatus as claimed in claim 20, further comprising waste composition determination means for at least partially determining a composition of waste fed to the said chamber.

23. Apparatus as claimed in claim 22, wherein said waste composition determination means is operatively connected to said control means.

24. Apparatus as claimed in claim 8, further comprising a second decongestion system for decongesting waste within said waste converting apparatus, said second decongestion system comprising:

at least one fluxing agent inlet means in said chamber separate from said waste inlet means, for selectively providing at least a quantity of at least one fluxing agent to a lower part of said chamber for at least partially removing a solid deposition type congestion and/or high viscosity liquid product-type congestion from said chamber, and/or to substantially prevent occurrence or propagation of such a congestion;

at least one said liquid product level sensing means at least for detecting a third predetermined status of a liquid product level in said chamber;

said at least one fluxing agent inlet means being selectively operable at least in response to said predetermined third status being detected.

25. Apparatus as claimed in claim 24, wherein said third predetermined status corresponds to a detected liquid product level substantially greater than a predetermined maximum.

26. Apparatus as claimed in claim 24, wherein said at least one liquid level sensing means is adapted for selectively detecting said second status or said third status of liquid product level.

27. Apparatus as claimed in claim 24, wherein said at least one liquid level sensing means comprises a visual indicator that enables an operator of said apparatus to view directly said liquid level.

28. Apparatus as claimed in claim 27, wherein said visual indicator comprises a suitable window.

29. Apparatus as claimed in claim 24, wherein said at least one fluxing agent inlet means is located intermediate between said at least one liquid products outlet means and said waste inlet means.

30. Apparatus as claimed in claim 24, wherein said at least tone fluxing agent inlet means is located intermediate between said primary plasma torch means and said waste inlet means.

31. Apparatus as claimed in claim 30, wherein at least one said fluxing agent inlet means is vertically spaced from said primary plasma torch means by a predetermined spacing such as to enable a fluxing agent provided to said chamber via said fluxing agent inlet means to be substantially melted by means of said primary torch means.

32. Apparatus as claimed in claim 24, wherein said fluxing agent inlet means is operatively connected to at least one suitable source of fluxing agent.

33. Apparatus as claimed in claim 24, further comprising at least one secondary plasma torch means having an outlet in said chamber such that during operation of said system a high temperature zone may be selectively provided within said converting chamber such as to enable a fluxing agent provided to said chamber via said fluxing agent inlet means to be substantially melted by means of said secondary torch means.

34. Apparatus as claimed in claim 33, wherein said at least one fluxing agent inlet means and said at least one second plasma torch means are disposed in a mixing chamber in communication with said chamber.

35. Apparatus as claimed in claim 24, wherein at least one said fluxing agent is provided in powdered form.

36. Apparatus as claimed in claim 24, wherein at least one said fluxing agent is provided in granulated form.

37. Apparatus as claimed in claim 24, wherein at least one said fluxing agent is chosen from among $SiO_2$ (or sand), CaO (or $CaCO_3$), MgO, $Fe_2O_3$, $K_2O$, $Na_2O$, $CaF_2$, borax, dolomite, or any other suitable fluxing material including any suitable composition comprising at least one suitable fluxing material.

38. A method for decongesting an apparatus for converting waste, wherein said apparatus comprises a waste converting chamber adapted for accommodating a column of waste;

at least one primary plasma torch means for generating a hot gas jet at an output end thereof and for directing said jet towards a lower longitudinal part of the chamber;

at least one liquid product outlet means at a lower longitudinal part of said chamber;

wherein said method comprises:—

(a) providing at least one secondary plasma torch means having an outlet in said chamber such that during operation of said system a high temperature zone may be selectively provided within said converting chamber for at least partially removing a bridge-type congestion from said chamber and/or to substantially prevent occurrence or propagation of such a congestion;

(b) monitoring the flow rate of waste within said chamber via suitable waste flow rate sensing means;

(c) monitoring the level of liquid products at a lower longitudinal part of said apparatus via suitable liquid product level sensing means;

(d) if the volume flow rate at (b) decreases below a predetermined minimum and the level at (c) does not substantially increase/above a predetermined maximum value, operating at least one said second plasma torch means;

(e) maintaining operation of said secondary plasma torch means until the waste flow rate at (b) is substantially restored to its predetermined minimum or until the level at (c) is substantially restored to its predetermined maximum, whereupon steps (b) to (e) are repeated.

39. A method as claimed in claim 38, wherein said at least one said secondary plasma torch in step (a) is provided at a lower portion of said chamber and at least one other said secondary plasma torch is provided at an upper part of said chamber with respect to said lower portion, and wherein steps (d) and (e) are replaced with the following steps:—

(f) if the volume flow rate at (b) decreases below a predetermined minimum and the level at (c) does not substantially increase above a predetermined maximum value, operating at least one said second plasma torch means at said lower end of said chamber according to a first operating mode;

(g) if the volume flow rate at (b) is still below said predetermined minimum and the level at (c) has not substantially increased above said predetermined maximum value, operating at least one said second plasma torch means at said upper part of said chamber;

(h) maintaining operation of said secondary plasma torch means at the upper part of said chamber until the waste flow rate at (b) is substantially restored to its predetermined minimum or until the level at (c) is substantially restored to its predetermined maximum, whereupon steps (b), (c), (f), (g) and (h) are repeated.

40. A method according to claim 39, wherein said first operating mode comprises activating the said at least one secondary plasma torch at said lower end of said chamber for a predetermined time interval and then deactivating the same.

41. A method according to claim 38, wherein said apparatus further comprises at least one fluxing agent inlet means in said chamber separate from said waste inlet means, for selectively providing at least a quantity of at least one fluxing agent to a lower part of said chamber for at least partially removing a solid deposition type congestion and/or high viscosity liquid product-type congestion from said chamber, and/or to substantially prevent occurrence or propagation of such a congestion, said method further comprising the steps;

(i) if the level at (c) substantially increases above said predetermined maximum value, operating at least one said second plasma torch means at said lower end of said chamber according to a second operating mode;

(j) if the level at (c) has not decreased to at least said predetermined maximum value, operating at least one said second plasma torch means at said upper part of said chamber;

(k) providing a predetermined quantity of at least one fluxing agent to chamber via said fluxing agent inlet means until the level at (c) is substantially restored to its predetermined maximum, whereupon steps (b), (C), (i), (j) and (k) are repeated.

42. A method according to claim 41, wherein said second operating mode comprises activating the said at least one secondary plasma torch at said lower end of said chamber for a predetermined time interval and then deactivating the same.

* * * * *